US007331859B2

(12) United States Patent
Hornik et al.

(10) Patent No.: US 7,331,859 B2
(45) Date of Patent: Feb. 19, 2008

(54) WAGERING GAME WITH AWARD FEATURE FOR SUBSETS OF GAME OUTCOMES

(75) Inventors: Jeremy M. Hornik, Chicago, IL (US); Michael W. Mastropietro, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 660 days.

(21) Appl. No.: 10/955,016

(22) Filed: Sep. 30, 2004

(65) Prior Publication Data

US 2006/0068874 A1 Mar. 30, 2006

(51) Int. Cl.
*A63F 9/24* (2006.01)

(52) U.S. Cl. ..... 463/16; 463/25; 463/31

(58) Field of Classification Search ..... 463/13, 463/16–20, 30–31

See application file for complete search history.

(56) References Cited

U.S. PATENT DOCUMENTS

| | | | | |
|---|---|---|---|---|
| 6,439,995 | B1 | 8/2002 | Hughs-Baird et al. | 463/20 |
| 6,511,375 | B1 | 1/2003 | Kaminkow | 463/20 |
| 6,592,457 | B1 | 7/2003 | Frohm et al. | 463/16 |
| 6,645,073 | B2 | 11/2003 | Lemay et al. | 463/20 |
| 6,652,378 | B2 | 11/2003 | Cannon et al. | 463/20 |
| 6,685,561 | B2 | 2/2004 | Anderson et al. | 463/16 |
| 6,733,386 | B2 | 5/2004 | Cuddy et al. | 463/17 |
| 6,746,527 | B1 | 6/2004 | McElligott et al. | 106/31 |
| 6,796,899 | B2 | 9/2004 | Baerlocher | 463/16 |
| 6,796,902 | B2 | 9/2004 | Baerlocher et al. | 463/20 |
| 6,817,944 | B2 | 11/2004 | Kaminkow et al. | 463/16 |

*Primary Examiner*—Scott E. Jones
(74) *Attorney, Agent, or Firm*—Nixon Peabody, LLP.

(57) ABSTRACT

A method and gaming terminal for playing a wagering game. The method includes conducting the wagering game at a gaming terminal. A plurality of player-selectable game elements are displayed, such that the game elements are divided into a plurality of types. A player selects at least one of the game elements and a predetermined award amount is then revealed. If the player selects an award-all-of-type element, then all of the game elements associated with that particular type are revealed. The player then receives a wagering game payoff based on the selection.

32 Claims, 7 Drawing Sheets

WAGERING GAME WITH AWARD FEATURE FOR SUBSETS OF GAME OUTCOMES

FIELD OF THE INVENTION

The present invention relates generally to gaming terminals for playing a wagering game and, more particularly, to a gaming terminal having a feature for awarding all outcomes of a particular type.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been employed is the use of a progressive jackpot. In the gaming industry, a "progressive" involves collecting coin-in data from participating gaming device(s) (e.g., slot machines), contributing a percentage of that coin-in data to a jackpot amount, and awarding that jackpot amount to a player upon the occurrence of a certain jackpot-won event. The percentage of the coin-in is determined prior to any result being achieved and is independent of any result. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

In some current bonus games, the player is either awarded a set number of picks. Players can become bored with this type of game because the player can only win a percentage of the total bonus amount. Also, every pick is only worth its face value.

At least one bonus game has been developed to overcome these obstacles. In this game there is a multiple level bonus game and a player can select a set number of bonus items on a particular level. At least one of the choices on each level allows the player to win all of the bonus items on a particular level. Also, there is a bonus item that allows the player to move between the various levels. However, this game does not differentiate bonus items by type and does not allow players to win all of the bonus items associated with a particular type.

Thus, there is a need to allow a player to win all of the bonus items associated with a particular type in order to generate player excitement.

SUMMARY OF THE INVENTION

The present invention solves the aforementioned problems by creating a wagering game that allows a player to win all of a certain type of element upon selecting an "AWARD ALL" of type symbol.

The present invention involves a method of playing a wagering game. The wagering game allows a player to conduct a wagering game at a gaming terminal. A plurality of player-selectable game elements are displayed. These plurality of player-selectable game elements are divided into a plurality of types. At least one of the plurality of player-selectable game elements are selected via player inputs and a predetermined award amount of the selected player-selectable game elements is revealed. If the player should select an "AWARD ALL" of type element associated with a particular type, then all of the player-selectable elements associated with that particular type of the plurality of types is revealed and the player is awarded a wagering game payoff based upon the selection.

In another aspect of the present invention, a method of playing a wagering game is provided. In this embodiment, a wagering game is conducted at a gaming terminal and a plurality of player-selectable objects is displayed. The player-selectable elements are associated with a plurality of indicia during the wagering game and are divided into a plurality of types. Via player inputs, a number of the plurality of player-selectable elements are selected. The selected indicia and its associated types are then revealed. In response to the selected indicia containing a type-award indicia, then all of the indicia corresponding to that particular type are revealed. The wagering game then awards a payoff that is based on the revealing.

Another embodiment of this invention is for a gaming terminal that includes a wagering game having a plurality of player-selectable game elements. Each of the plurality of player-selectable game elements is hiding one of plurality of indicia. The gaming terminal displays the plurality of player-selectable game elements, and the associated indicia are revealed after a player selection. In response to the associated indicia including an award-all-of-like-indicia symbol, all of the player-selectable game elements of the same indicia are revealed.

In yet another embodiment of the present invention, there is a gaming system that includes at least one display and at least one gaming terminal for playing a wagering game. The gaming system also includes a controller coupled to the at least one gaming terminal and the at least one display. The controller can cause the display to display a plurality of player-selectable game elements, such that the plurality of player-selectable game elements initially hiding a plurality of indicia. The controller can also cause the display to reveal the indicia of selected game elements and all of the game-selectable elements of a particular indicia in response to a selection of an award-all-of-like-indicia.

In another aspect of the present invention, a gaming terminal for playing a wagering game having a basic game and a bonus game includes an input device for receiving inputs from a player during the wagering game, the inputs including a wager amount. The gaming terminal also includes a display for displaying a randomly selected outcome of the wagering game in response to receiving the wager amount from the player. A controller is also included as part of the gaming terminal. In response to the bonus game being triggered, the controller causes the display to display a plurality of player-selectable game elements, the player-selectable game elements divided into a plurality of types, and for the display to reveal the selected game elements. If an "AWARD-ALL" of a particular type element is selected, the controller then causes the display to reveal all of the player-selectable game elements of a particular type.

The above summary of the present invention is not intended to represent each embodiment or every aspect of the present invention. The detailed description and FIGS. will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
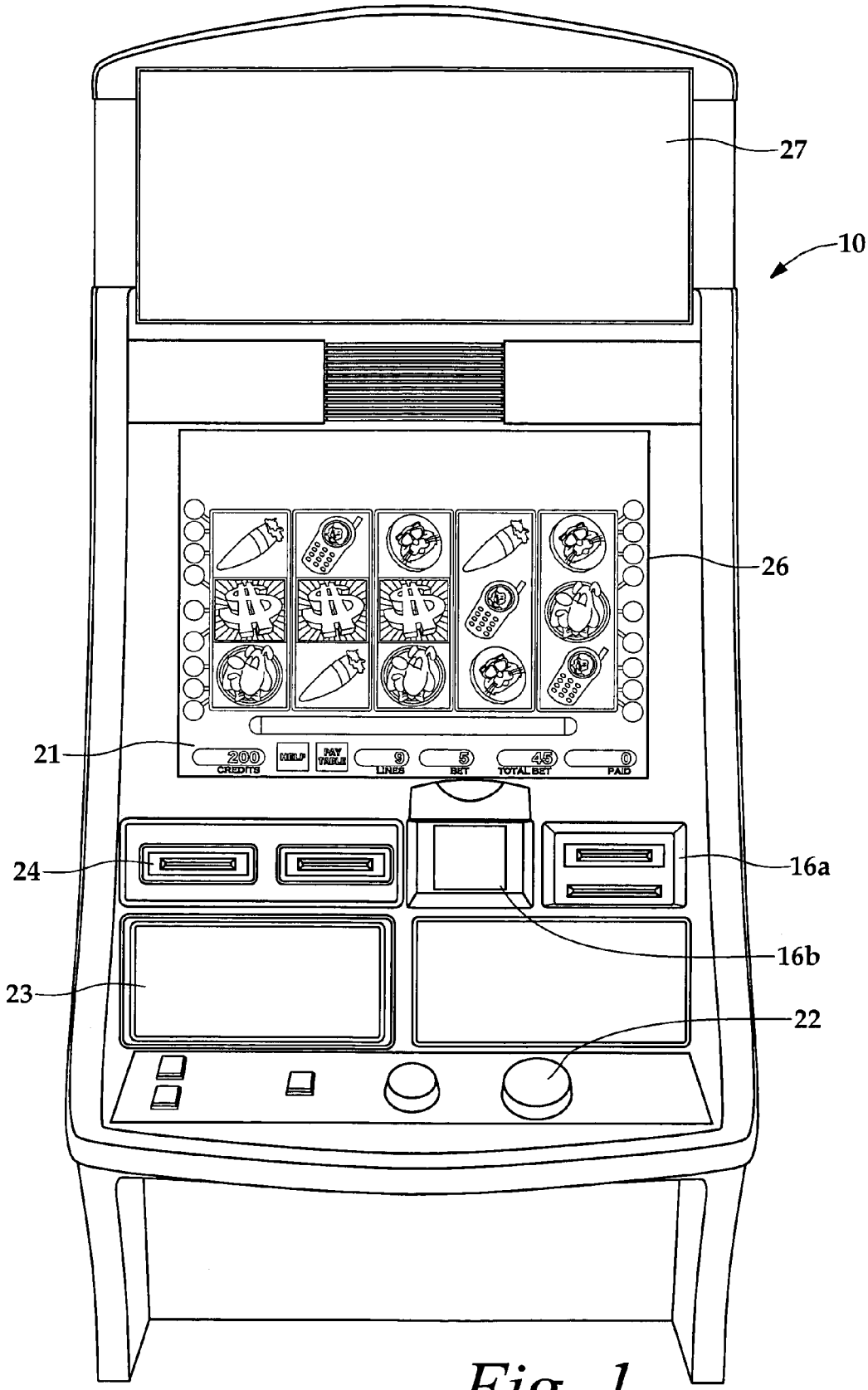
FIG. 1 is a perspective view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a perspective view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager accepter 16*b*), a touch screen 21, a push-button panel 22, and an information reader 24. For outputs, the gaming terminal 10 includes a payout mechanism 23, a main display 26 for displaying information about the basic wagering game, and a secondary display 27 that may display an electronic version of a pay table, and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

Also included is the payout mechanism 23, which performs the reverse functions of the wager acceptor. For example, the payout mechanism 23 may include a coin dispenser or a note dispenser to output value from gaming terminal 10. Also, the payout mechanism 23 may also be adapted to receive a card that authorizes the gaming terminal to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome, as well.

In some embodiments, the information reader 24 is a card reader that allows for identification of a player by reading a card with information indicating his or her true identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the casino's computers to register that player's wagering at the gaming terminal 10. The information reader 24 may also include a keypad (not shown) for entering a personal identification number (PIN). The gaming terminal 10 may require that the player enter their PIN prior to obtaining information. The gaming terminal 10 may use the secondary display 27 for providing the player with information about his or her account or other player-specific information. Also, in some embodiments, the information reader 24 may be used to restore assets that the player achieved during a previous game session and had saved.

Figure 2:
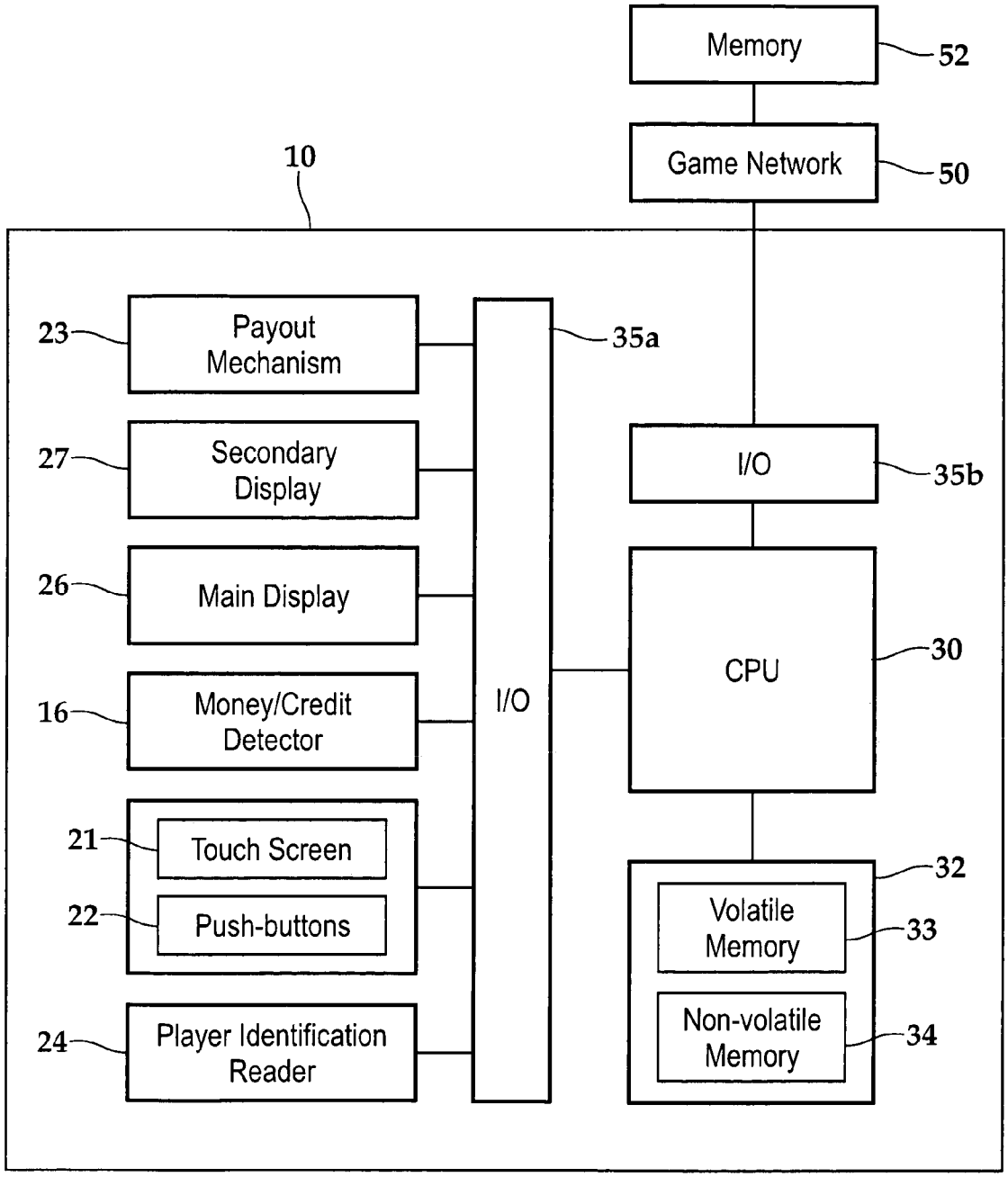
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes a game program that allows for the randomly selected outcome. The CPU 30 is also coupled to or includes a local memory 32. The local memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the local memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 50 having control circuitry and memory devices. The game control network 50 may optionally include a system memory 52 for alternative storage of data. The game network 50 can include instructions for playing games, such as progressive jackpots that are contributed to by all or some of the gaming terminals 10 in the network 50. The gaming terminal 10 often has multiple serial ports, each port dedicated to providing data to a specific host computer system that performs a specific function (e.g., account system, player-tracking system, progressive game control system, etc. . . . ). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the advantages of the RS-485 capability (e.g., multi-drop capability that allows many gaming terminals 10 to communicate with the game control network 50). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 50.

In other embodiments, the information reader 24 may include a card reader, and the unique identifier provided at the gaming terminal 10 may be stored on a personal identification card, such as one described above. Or, the gaming terminal 10 includes a radio frequency identification device (RFID) transceiver or receiver so that an RFID transponder held by the player can be used to provide the unique identifier of the player at the gaming terminal 10 without the need to insert a card into the gaming terminal 10. RFID components can be those available from Pacific Northwest National Laboratory (under the United States Department of Energy) of Richland, Wash.

In other embodiments, the information reader 24 may include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the gaming terminal so that the player can be recognized using a voice recognition system.

In summary, there are many techniques in which to provide a unique identifier for the player so that the assets accumulated by the player during one wagering session can be stored in either the system or local memory 52, 32, thereby allowing the player to subsequently access those assets at the same gaming terminal 10 or a different gaming terminal within the network 50. As described below with reference to FIGS. 3A to 10, various assets related to the wagering game features and formats can be stored after one gaming session and used in a subsequent gaming session(s) to enhance the gaming experience for the player.

Figure 3:
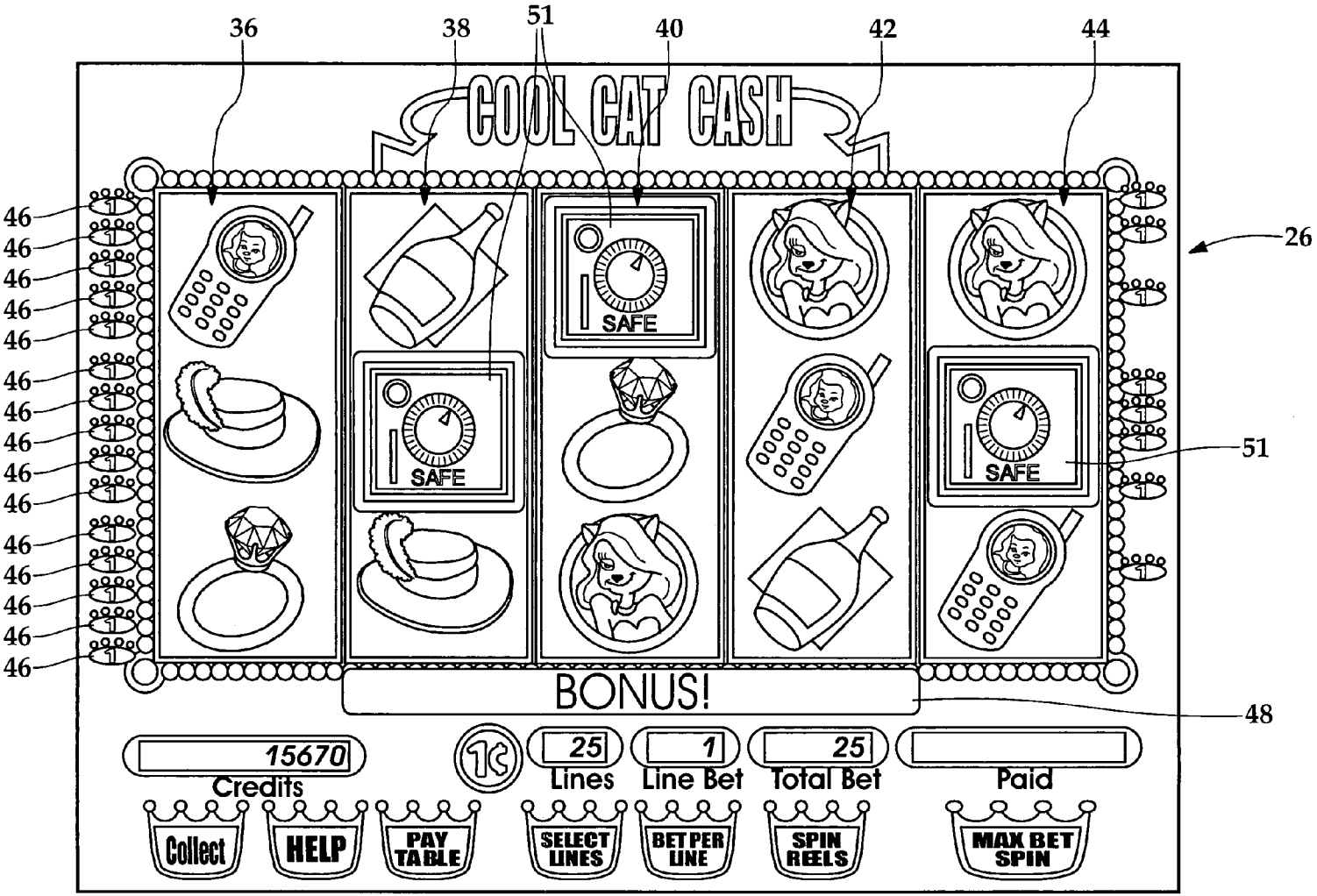
FIG. 3 illustrates a main display of the gaming terminal of FIG. 1.

Turning now to FIG. 3, the main display 26 of one embodiment of the present invention is shown in more detail. In this embodiment, the basic game is a slot machine game, with symbols on five different reels 36, 38, 40, 42, 44. The reels 36-44 may be either traditional mechanical reels or they may be computer-generated images of reels, with each reel composed of a plurality of symbols. The payline indicators 46 indicate a randomly selected outcome for each payline, which is the combination of symbols on the reels 36-44. Thereafter, an outcome indicator 48 indicates whether the outcome has resulted in a payout, a progressive jackpot, a bonus game, or whether it resulted in nothing. While multiple paylines are shown, a gaming terminal 10 with a single payline will also work with the present invention.

In the present example, the wagering game shown is Cool Cat Cash, where the symbols include a cell phone, a champagne bottle, a safe, a picture of a female cat, and a hat. Various combinations of the symbols can result in prizes, including monetary and non-monetary prizes. The non-monetary prizes include free spins, multipliers, entry into a bonus game, entry into a progressive game, etc.

In this particular embodiment, as shown in FIG. 3, a particular combination of symbols generates entry into a card-based bonus game. The game enters the bonus stage when three of a particular symbol appear on the main display 26. In this embodiment, the particular symbol is a safe 51. In other embodiments, other symbols and/or symbol combinations may trigger the bonus game.

Figure 4:
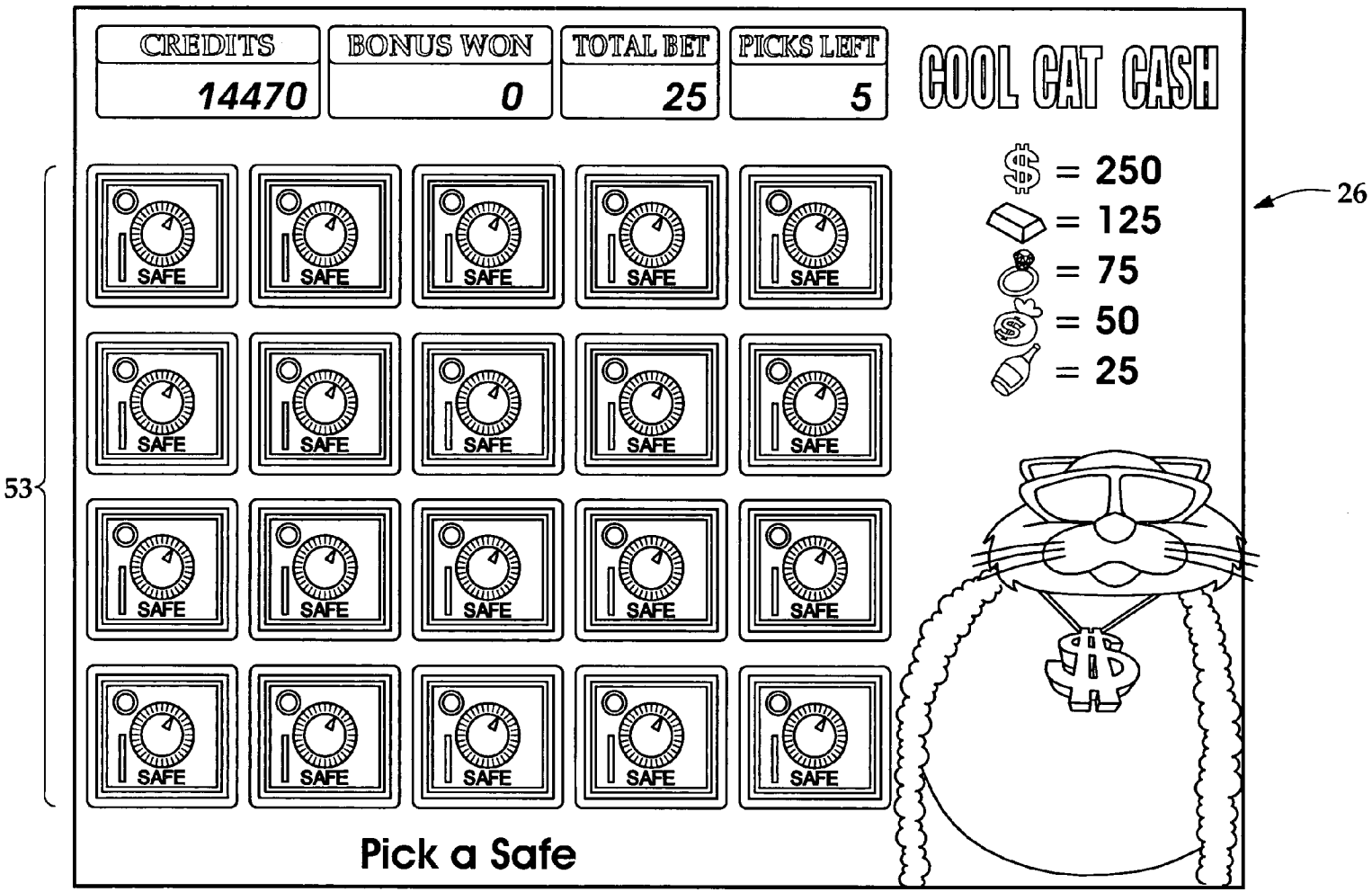
FIG. 4 illustrates an initial bonus game screen of the gaming terminal of FIG. 1.
Figure 5:
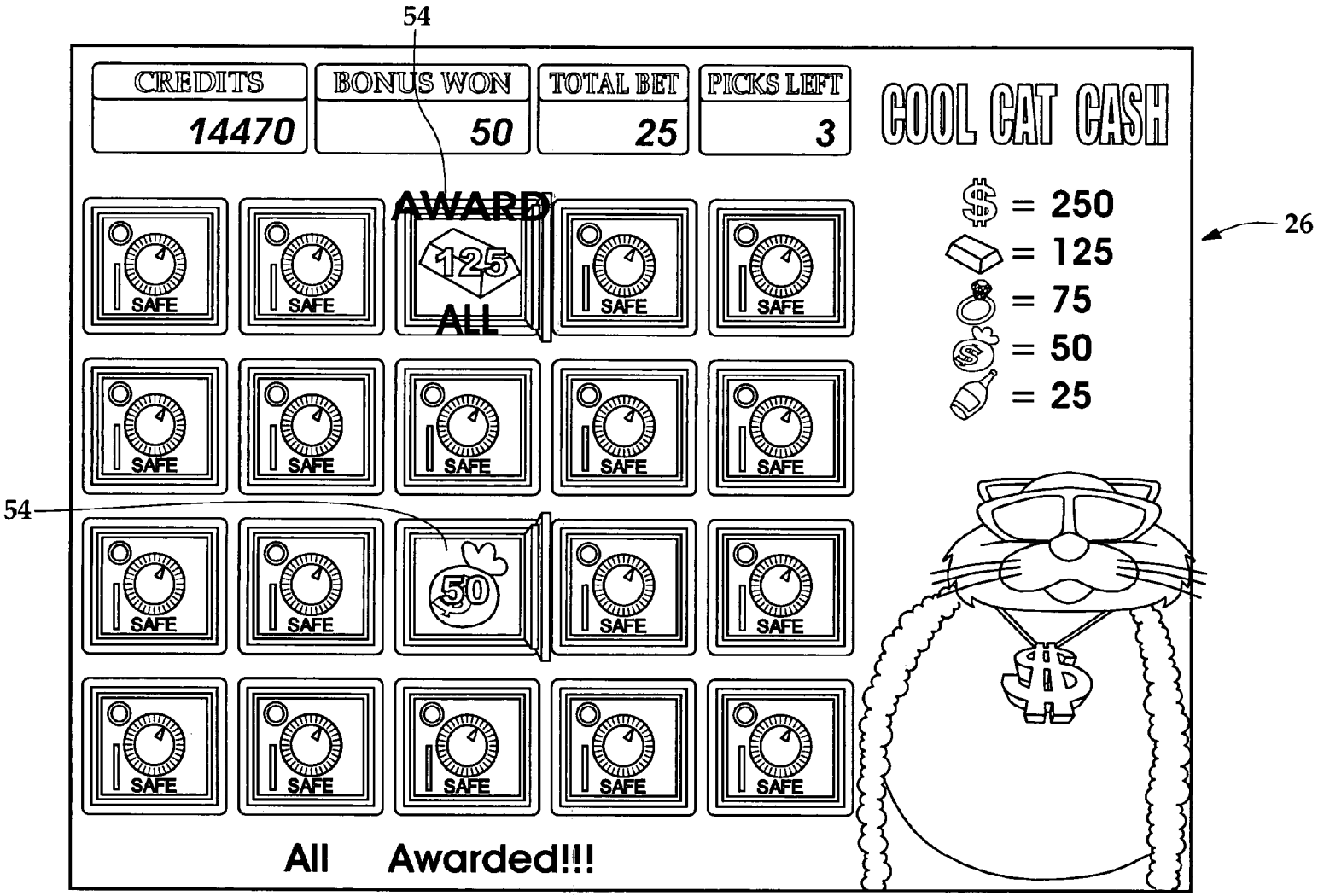
FIG. 5 illustrates another bonus game screen of the gaming terminal of FIG. 1.

Turning now to FIG. 4, a display of the bonus game is shown that is triggered by the symbol combination in the basic game, as shown in FIG. 3. In this embodiment, the bonus game includes a number of safes 53 shown in a closed position. Each safe contains a bonus award associated with a particular type. In this embodiment, there are five different types of bonus awards: a money symbol worth 250 credits, a gold bar worth 125 credits, a ring worth 75 credits, a bag of money worth 50 credits and a champagne bottle worth 25 credits. In addition, one of each type of pick is an "AWARD-ALL" of type pick, which grants the player the award for all of that type of prize located on the grid. After the player selects one of the safes 53, either by pressing the safe 53 on the touch screen 21 (FIGS. 1 and 2) or by giving the coordinates of the safe 53, the selected safe 54 is revealed to the player (FIG. 5). In the embodiment illustrated in FIG. 5, the player selected a safe that is of the bag type worth 50 credits and an "AWARD ALL" of the "gold bar" type.

Figure 6:
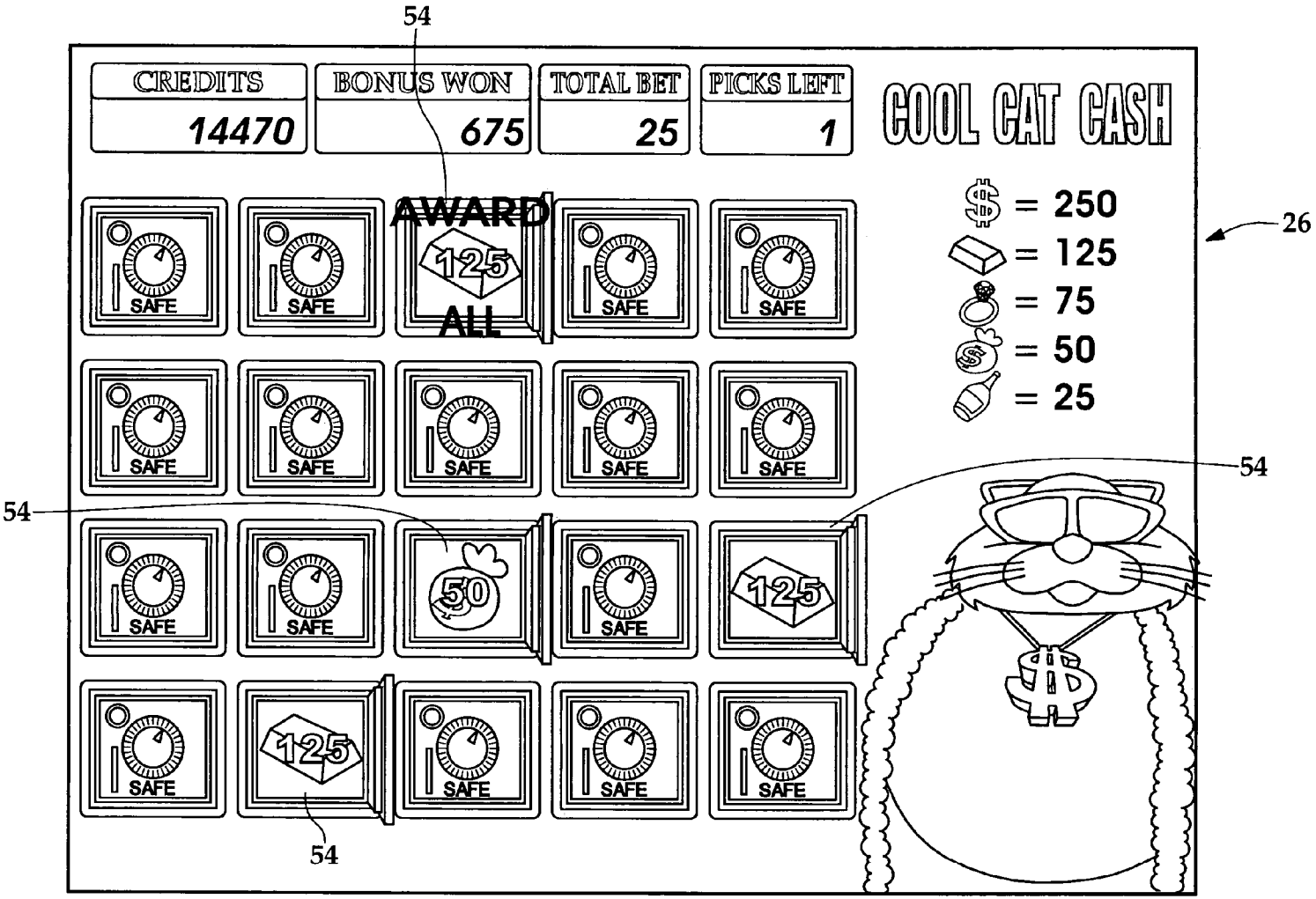
FIG. 6 illustrates another bonus game screen of the gaming terminal of FIG. 1.

As shown in FIGS. 5 and 6, once the player selects a safe containing an "AWARD ALL" symbol relating to one type of bonus symbol, all of the other safes containing that bonus symbol are highlighted (FIG. 5) and opened (FIG. 6). In this embodiment, two other safes containing the gold bar symbol were opened, awarding the player an additional 250 credits.

In this embodiment, the player is allowed to make five selections. Because the player has only made two selections, the player is given three more selections. In other words, the safes opened by achieving the "AWARD ALL" safe do not count as a selection made by the player.

The above screens were related to a particular embodiment, where the bonus game relates to a safes. In other embodiments, the bonus game could be other indicia, such as reel symbols from a standard slot machine or a deck of cards, or other types of symbols, so long as there are a plurality of different types of symbols.

In some embodiments, there may also be included a safe that includes an "AWARD ALL OF ALL TYPES" symbol that automatically opens all of the safes.

Figure 7:
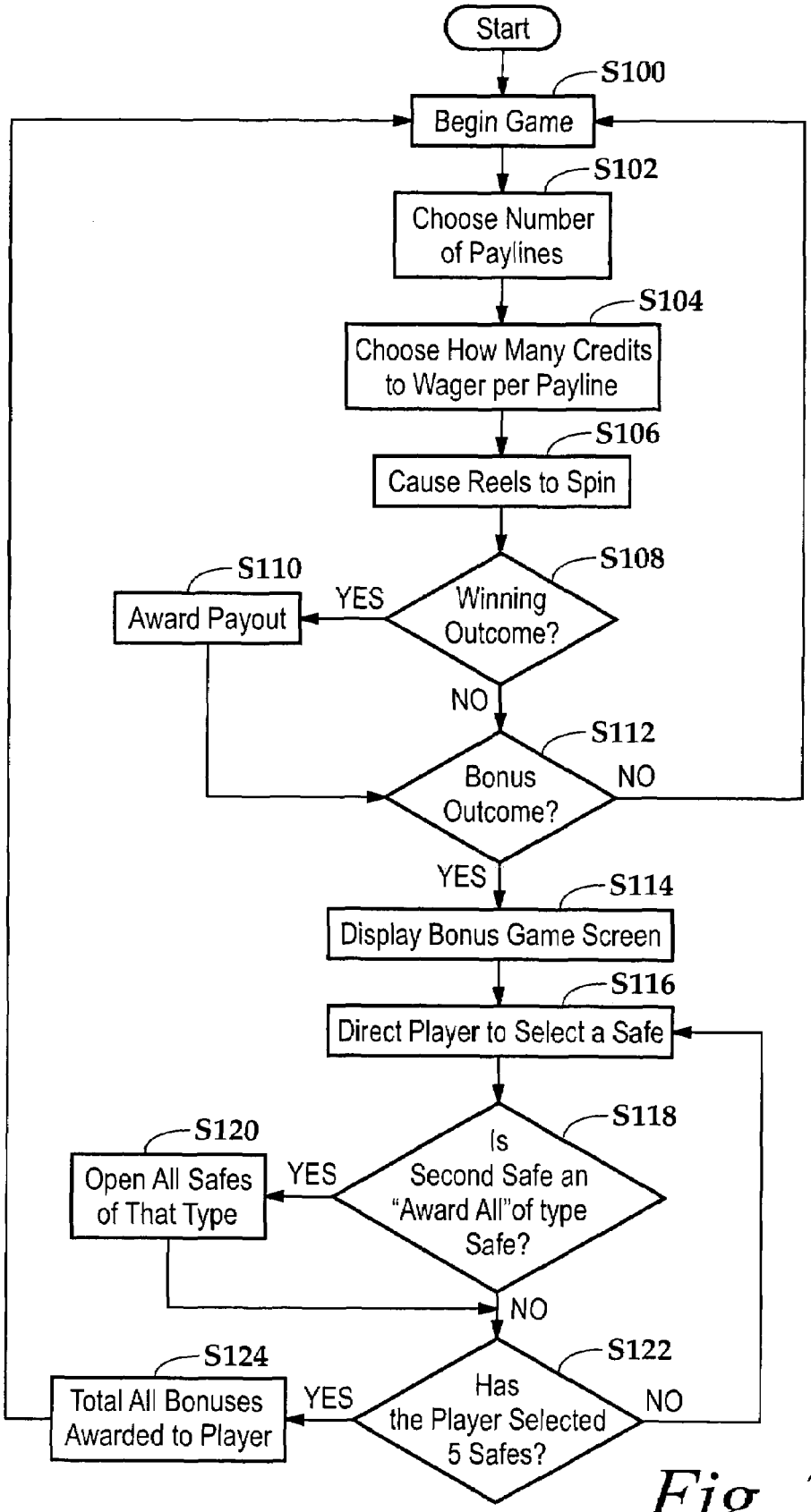
FIG. 7 is a flow chart describing the method of operation according to one embodiment of the present invention.

Turning now to FIG. 7, the operation detailing the method of playing the game according to the illustrated embodiment of the invention will be described. In step s100, a player at the gaming terminal 10 begins a gaming session by any conventional method (e.g., inserting coins or using credits). The gaming terminal 10 has a basic wagering game that involves a player making various inputs, including, for example, choosing a number of paylines to play (step s102). In some embodiments, there are a maximum of nine paylines, as shown in the gaming terminal 10 of FIG. 1. In other embodiments, there may only be a single payline. In those embodiments, this step would be skipped. After choosing how many paylines to play, the player selects how many credits (e.g., 1-5) to wager on each payline (step s104).

Regarding eligibility for the bonus game, in some embodiments, the player is only eligible for the bonus game if the player chooses to play all of the paylines and/or the player wagers the maximum amount on each of the paylines played. In other embodiments, the player is automatically eligible for the bonus game, and is not required to make a minimum wager or to play a minimum number of lines. In some other embodiments, there is a "side-wager" option that allows the player to be eligible for the bonus game. The "side-wager" option is described in U.S. patent application Ser. No. 10/659,878, filed on Sep. 11, 2003, entitled "Gaming Machine With Multi-Level Progressive Jackpot," which is commonly owned and herein incorporated by reference in its entirety.

At step s106, the player begins the basic wagering game, thereby causing the reels to spin and display a symbol combination that corresponds to the randomly selected outcome from the CPU 30 (FIG. 2). At step s108, it is determined if the randomly selected outcome (i.e., arrangement of symbols) is one of the winning outcomes according to a basic-game pay table (not shown). If the answer is "yes," then the gaming system progresses to step s110, and awards the player with the associated payout amount.

If the answer at step s108 is "no," or, after the payout has been awarded at step s110, then the gaming terminal 10 determines whether the randomly selected outcome matches one of the outcomes associated with entering a bonus game (e.g. having three safe symbols scattered on the main display 26 as discussed above) (step s112). If the answer is "no", the game returns to step s100 and the game begins again.

If the randomly selected outcome is a start-bonus outcome that causes entry to the bonus game, then gaming terminal 10 advances to step s114, and the bonus game screen is displayed. As stated above in reference to FIGS. 4-6, the bonus game is set up as an array of safes 54. The player is then directed to select a safe (step s116), which is then opened (the opened safes 56 of FIGS. 5 and 6).

The gaming terminal 10 then determines at step s118 whether the safe contains an "AWARD-ALL" of type symbol. If the answer is "yes," then all of the safes containing that type of symbol are opened (step s120). The game then continues to step s122 and determines whether the player has selected five safes. If the answer is "no," the game returns to step s116, and the player is directed to choose another safe. If the answer is "yes," the game then adds up the total awards contained in all of the safes opened, awards that amount to the player, and then returns to step s100.

If the answer at step s118 is "no," then the game continues onto step s122, and proceeds as described as above.

In the embodiment described, the player is awarded five selections. However, it should be understood that the number of selections may not be five, but can be any predetermined number. In other embodiments, the player continues to pick until an "END OF GAME" symbol such as a joker or a "pooper" is chosen, which ends the bonus game. In those embodiments, at step s122, the game determines whether the chosen safe contains a game ending symbol (instead of determining whether the player has chosen five safes).

In some embodiments, the awards given by the bonus game may not be credits, or monetary in nature. The awards may be non-monetary awards, such as free spins, multipliers, wild cards, etc. In some embodiments, the different types can include both monetary and non-monetary awards (e.g., the champagne bottle may be worth five free spins and the gold bar may be worth 125 credits).

Although the above embodiments have been described relative to a bonus game, it should be understood that the invention could be used in the basic game of the gaming terminal 10. In such an embodiment, the safes are selected as a part of the basic game.

While the invention is susceptible to various modifications and alternative forms, specific embodiments thereof have been shown by way of example in the drawings and herein described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

What is claimed is:

1. A method of playing a wagering game, comprising:

conducting the wagering game at a gaming terminal;

displaying a plurality of player-selectable game elements on a display, the plurality of player-selectable game elements being divided into a plurality of types;

selecting, via player inputs, at least one of the plurality of player-selectable game elements;

revealing a predetermined award amount of the selected player-selectable game element;

revealing all of the player-selectable elements associated with one of a particular type of the plurality of types, in response to the selected player-selectable game element being an award-all-of-type element associated with the one particular type; and awarding a wagering game payoff based on the selection.

2. The method of claim 1, wherein the selectable game elements comprise cards from a deck of playing cards.

3. The method of claim 1, wherein the selectable game elements comprise reel symbols.

4. The method of claim 1, further including receiving player-identification information, the awarding step comprising crediting an amount to a player account indicated in the player-identification information.

5. The method of claim 1, wherein the wagering game includes a basic game, and the plurality of player-selectable game elements are displayed during the basic game.

6. The method of claim 1, wherein the wagering game includes a basic game and a bonus game, the basic game having a plurality of outcomes including a start-bonus game outcome, and the plurality of player-selectable game elements are displayed during the bonus game, in response to achieving the start-bonus game outcome in the basic game.

7. The method of claim 1, wherein the plurality of player-selectable elements contain one award-all-of-type element associated with one particular type for each of the plurality of types.

8. The method of claim 7, further comprising revealing all of the player-selectable game elements in response to an award-all-of-all-types element being selected.

9. The method of claim 1, further comprising revealing all of the player-selectable game elements in response to an award-all-of-all-types element being selected.

10. The method of claim 1, wherein the revealing of the selected game element is performed until an at least one end-wagering game outcome is achieved.

11. The method of claim 1, wherein the revealing of the selected game element is performed until a predetermined number of selections is made.

12. A method of playing a wagering game, comprising:

conducting the wagering game at a gaming terminal;

displaying on a display a plurality of player-selectable objects associated with a plurality of indicia during the wagering game, the plurality of indicia being divided into a plurality of types;

selecting, via player inputs, a number of the plurality of player-selectable elements;

revealing the selected indicia and its associated type;

revealing all of the indicia corresponding to a particular type in response to the selected indicia containing a type-award indicia; and awarding a wagering game payoff based on the revealing.

13. The method of claim 12, wherein the selecting step continues until a game-ending indicia is revealed.

14. The method of claim 12, wherein the selecting step continues until a predetermined number of indicia is chosen.

15. The method of claim 14, wherein the predetermined number of indicia is five.

16. The method of claim 12, wherein the wagering game includes a basic game and the plurality of indicia are displayed during the basic game.

17. The method of claim 16, wherein the wagering game includes a basic game and a bonus game, the method further comprising:

achieving a bonus-game-entry-outcome at the gaming terminal; and activating the bonus game in response to achieving the bonus-game-entry-outcome;

wherein the plurality of indicia are displayed during the bonus game.

18. A gaming terminal comprising:

a display; and a controller configured to conduct a wagering game, to display on the display a plurality of player-selectable game elements, each of the plurality of player-selectable game elements hiding one of plurality of indicia, and to reveal on the display the indicia associated with a player-selectable game element after a player selection, the controller further being configured to reveal on the display, responsive to a player selection of a player-selectable game element associated with the award-all-of-like-indicia, all of the player-selectable game elements associated with the same indicia as that of the award-all-of-like-indicia.

19. The gaming terminal of claim 18, wherein the wagering game includes a basic game and the player-selectable game elements are displayed during the basic game.

20. The gaming terminal of claim 18, wherein the wagering game includes a basic game and a bonus game, the basic game having a plurality of symbols that indicate a randomly selected outcome of the basic game, and the plurality of player-selectable game elements are displayed in response to the randomly selected outcome being a start-bonus game outcome.

21. The gaming terminal of claim 20, wherein the start-bonus game outcome comprises achieving three of a particular symbol in the basic game.

22. The gaming terminal of claim 18, wherein the plurality of player-selectable game elements includes at least one award-all-of-like-indicia for each of the plurality of indicia.

23. The gaming terminal of claim 18, wherein the plurality of player-selectable game elements includes at least one award-all indicia, the selection of which causes all of the plurality of player-selectable game elements to be revealed.

24. A gaming system comprising:

at least one display;

at least one gaming terminal for playing a wagering game; and a controller coupled to the at least one gaming terminal and the at least one display, the controller operative to (i) cause the display to display a plurality of player-selectable game elements, the plurality of player-selectable game elements initially hiding a plurality of indicia, and (i) cause the display to reveal the indicia of selected game elements and all of the game-selectable elements of a particular indicia in response to a selection of an award-all-of-like-indicia.

25. The gaming system of claim 24, wherein the controller is further operative to determine a payoff amount based upon the revealed indicia.

26. The gaming system of claim 24, wherein the display is further operable to display the value associated with each of the plurality of value-associated outcomes.

27. The gaming system of claim 24, wherein the controller is housed within the at least one gaming terminal.

28. The gaming system of claim 24, wherein the wagering game includes a basic game and a bonus game, the controller triggering the bonus game when a start-bonus outcome is achieved in the basic game, and the controller is operative to cause the display to display the plurality of player-selectable elements in response to the start-bonus outcome being achieved.

29. A gaming terminal for playing a wagering game having a basic game and a bonus game, comprising:

an input device for receiving inputs from a player during the wagering game, the inputs including a wager amount;

a display for displaying a randomly selected outcome of the wagering game in response to receiving the wager amount from the player; and a controller operative to (i) in response to the bonus game being triggered, cause the display to display a plurality of player-selectable game elements, the player-selectable game elements divided into a plurality of types, (ii) cause the display to reveal the selected game elements, and (iii) cause the display to reveal all of the player-selectable game elements of a particular type in response to a selection of an award-all of a particular type element.

30. The gaming terminal of claim 29, wherein the controller is operative to continue revealing the player-selectable game elements until a player selects an end-bonus indicia.

31. The gaming terminal of claim 29, wherein the controller is operative to reveal, a set number of indicia.

32. The gaming terminal of claim 29, wherein the set number of indicia is equal to five.

* * * * *